United States Patent [19]

Pheasant et al.

[11] Patent Number: 4,750,717

[45] Date of Patent: Jun. 14, 1988

[54] TUNDISHES

[75] Inventors: Stephen T. Pheasant, Jurong, Singapore; William McFarlane, Birmingham; Royston J. Phillips, Stourbridge, both of England

[73] Assignee: Foseco Trading A.G., Chur, Switzerland

[21] Appl. No.: 707,372

[22] Filed: Mar. 1, 1985

[30] Foreign Application Priority Data

Mar. 16, 1984 [GB] United Kingdom ..... 8406848

[51] Int. Cl.[4] ..... C21C 5/44

[52] U.S. Cl. ..... 266/286; 266/280; 266/275

[58] Field of Search ..... 266/280, 286, 285, 284, 266/275, 281, 282, 283

[56] References Cited

U.S. PATENT DOCUMENTS 4,042,229 8/1977 Eccleston ..... 266/280
4,194,730 3/1980 Matsumoto et al. ..... 266/280

FOREIGN PATENT DOCUMENTS 1494194 12/1973 United Kingdom .
2080505 2/1982 United Kingdom .

OTHER PUBLICATIONS

Geiger et al. "*Transport Phenomena in Metallurgy*" pp. 576–577, Dec. 1980.

*Primary Examiner*—L. Dewayne Rutledge
*Assistant Examiner*—S. Kastler
*Attorney, Agent, or Firm*—Nixon & Vanderhye P.C.

[57] ABSTRACT

A tundish for continuous casting of molten metal having an outer metal casing and, adjacent the casing, a permanent refractory lining is provided with an inner, expendable lining comprising refractory, heat-insulating slabs having an erosion resistant backing layer and an inward facing layer of lower density than that of the backing layer.

The density of the facing layer is at least 0.2 g/cm$^3$ but not more than 85% of the density of the backing layer. The presence of the inward facing layer exerts less chilling effect on the molten metal poured into the tundish than if the slab consisted of the backing layer alone.

17 Claims, 1 Drawing Sheet

TUNDISHES

Figure 1:
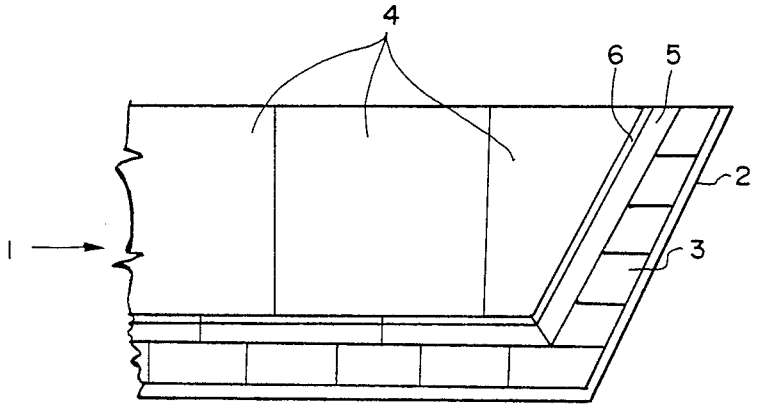

This invention relates to lined tundishes for use in metal casting, use of the tundishes and slabs for providing the lining.

In the continuous casting of metals, e.g. steel, molten metal is poured from a ladle into a continuous casting mould via an intermediate vessel which acts as a constant head reservoir and is called a tundish. The tundish has a metal floor and sidewalls and one or more outlets set in the floor or a sidewall. To protect the metal floor and sidewalls of the tundish from the effects of molten metal, it is usual to line the interior of the tundish with a relatively permanent lining, often made of bricks. The tundish may additionally be provided with an inner, expendable lining of refractory, heat-insulating slabs. This is described in British patent specification No. 1364665 and is highly advantageous.

Whilst only a limited life is required for the inner, expendable lining, this lining must satisfactorily survive throughout the passage of a ladleful of molten metal through the tundish and preferably for a sequence of ladlefuls. Over the years there has been a marked trend towards the provision of expendable lining slabs of improved resistance to the conditions of use in tundishes and substantial improvements have been achieved. An increase in density is well known to enhance the erosion resistance of the slabs and the above trend has been accompanied by a trend to slabs of higher densities.

According to the present invention a tundish, for use in the continuous casting of steel and having an outer metal casing and, adjacent the casing, a permanent lining of refactory material, is provided with an inner, expandable lining comprising refractory, heat-insulating slabs having an erosion-resistant backing layer, and an inward-facing layer of lower density than that of the backing layer.

Preferably the density of the inward-facing layer is not more than 85% of that of the backing layer, more preferably not more than 60% of that of the backing layer. Low densities are associated with low apparent specific heats (i.e. specific heats in relation to volume as opposed to mass) and thus molten metal initially poured into a tundish of the invention contacts matter of relatively low apparent specific heat i.e. the inward-facing layer rather than the denser, erosion-resistant backing layer. The density of the inward-facing layer is preferably at least 0.2 g/cm$^3$ whilst the density of the backing layer is preferably at least 1.0 g/cm$^3$ and may be as much as 2 g/cm$^3$ or more.

The inward-facing layer in accordance with the invention is not required to have good erosion resistance and, indeed, it may be sacrificial in nature, being wholly or largely consumed before a complete ladleful of molten metal has passed through the tundish. By virtue of the presence of the inward-facing layer of relatively low apparent specific heat, the slab exerts less chilling effect on molten metal poured into the tundish than if the slab consisted of the backing layer alone. Even if the backing layer is a highly erosion-resistant, high density layer, adequate thermal insulation during the period of use of the lined tundish can be achieved despite the fact that an increase in density is accompanied by an increase in thermal conductivity.

The present invention is based in part on an appreciation that, although erosion resistant, dense slabs may provide entirely satisfactory thermal insulation during their period of use, they exert a substantial initial chilling effect on the molten metal poured into the tundish. By reducing this initial chilling effect it is possible to save energy in that the molten metal in the ladle used to supply the tundish need not be at quite such a high temperature. Also, reducing the chilling effect means that in any case where the expendable lining would normally be pre-heated before the introduction of the molten metal into the tundish, the energy and time required for pre-heating can be reduced or the pre-heating omitted. Moreover, reducing the chilling effect decreases the risk of a tundish nozzle becoming blocked.

The invention is also based in part on the realisation that the chilling effect is short lived in comparison with the time required for a ladleful of molten metal to pass through the tundish and thus, despite the known emphasis on erosion resistance, the inward-facing layer can serve its purpose even if it only survives for a short time e.g. 15 minutes. The backing layer serves to provide the long term erosion-resistance and heat-insulation properties required.

The inward-facing layer may comprise particulate and/or fibrous refractory material and a binder. Part or all of any particulate refractory material present may be of low density e.g. calcined rice husks, fly ash floaters, expanded fireclay grog, expanded perlite, exfoliated graphite and charcoal. The layer may contain organic fibres e.g. pulped paper fibres. Examples of suitable fibrous refractory materials include aluminosilicate fibres and slag wool. The binder may be organic and/or inorganic. Examples of suitable binders are resins, e.g. urea-formaldehyde and phenol-formaldehyde resins, starches, phosphates, silicates, e.g. sodium silicate, and oxide sols e.g. silica sol. The layer may include an exothermically reactive ingredient such as an easily oxidisable metal e.g. aluminium and may also include an ingredient or ingredients that promote exothermic reaction of the exothermically reactive ingredient.

The backing layer is erosion resistant and preferably comprises particulate refractory material and a binder. Suitable particulate refractory materials include silica, silicon carbide, silicon nitride, chromite, alumina, zirconia, refractory silicates, including alumino-silicates, and magnesium oxide.

Preferably a total of 60–95% by weight of particulate refractory material is present. Refractory fibre is preferably also present, preferably in an amount of 0.5 to 15% by weight, and a proportion of organic fibre, preferably not more than 3% by weight, may also be present. Furthermore, a proportion, preferably not more than 20% by weight, of particulate carbonaceous matter may be included in order to enhance erosion resistance. The binder may be as described above for the inward-facing layer.

The thickness of the inward-facing layer is preferably in the range of 2 to 10 mm and the thickness of the backing layer is preferably in the range of 20 to 35 mm.

The inward-facing layer may, if desired, extend over only part of the inner face of the slab. In the case of a slab lining a sidewall of the tundish it may be preferred that at the upper part of the slab the full thickness of the slab is provided by the composition of the backing layer. The upper part of the slab contacted in use by slab on top of the molten metal in the tundish is subject to particularly severe conditions and having the full thickness of this part of the slab made of the erosion-resistant backing composition helps withstand these conditions. In any event, at the inner face of the slab there may be a border area where the full thickness of the slab is provided by the backing composition in order that the inward-facing layers of adjoining slabs are not in contact, thus minimising the risk of molten metal penetrating between adjoining slabs.

The inward-facing layer of the slabs may be made, for instance, by deposition from a slurry followed by heating to dry the slab and harden the binder. The backing layer may be made similarly. Preferably the inward-facing layer is formed first and put into, or allowed to remain in, a permeable mould and a slurry of the ingredients of the backing layer dewatered through it and the composite product then heated to dry it and to harden the binder for the backing layer (and for the inward-facing layer if that is formed in situ). Either or both the layers may be formed by means other than the slurry technique and the inward-facing layer does not have to be formed first. Either of the layers may be preformed in an independent operation before the composite structure is formed.

The backing layer itself may be composite. In particular, the inner face of the backing layer may be a dense, erosion-resistant layer having at its back a less dense, more heat-insulating layer.

The invention includes not only the lined tundish but also a method of continuously casting a metal in which the molten metal is poured into the lined tundish. The invention also includes the expendable inner lining slabs for use in assembling a lined tundish of the invention.

FIG. 1 is a side view, partly in cross-section and partly in elevation, of one form of exemplary tundish according ot the present invention.

In FIG. 1 the tundish is shown generally by reference numeral 1. The tundish includes an outer metal casing 2 having a conventional permanent refractory lining. The tundish also includes an inner expendable lining shown generally by reference numeral 4, and comprising a plurality of slabs. Each slab comprises two layers. The first layer of the slab comprises the layer 5 which is a backing layer and is erosion-resistant. The other layer of the slab comprises the layer 6 which is an inward-facing layer of lower density than the backing layer (e.g. a density of not more than 85 percent of the density of the backing layer, and preferably not more than 60 percent of the backing layer 5). The backing layer 5 is closer to the permanent lining 3 than the inward-facing layer 6. The expendable lining 4 is disposed of after the passage of a ladleful, or sequence of ladlefuls, of molten metal.

The invention is further described with reference to the following Examples.

EXAMPLE 1

The following ingredients in the percentages (by weight) specified were formed into a first aqueous slurry:

| Ingredient | % |
|---|---|
| aluminosilicate fibre | 55 |
| alumina | 14.5 |
| colloidal silica sol (30% solids) | 14.8 |
| aluminium powder | 7.4 |
| starch | 7.4 |
| aluminum sulphate | 0.9 |

The slurry was dewatered in a permeable mould.

The following ingredients in the percentages by weight specified were formed into a second aqueous slurry:

| Ingredient | % |
|---|---|
| magnesium oxide | 86.4 |
| boric acid | 2.4 |
| starch | 4.0 |
| urea-formaldehyde resin | 2.0 |
| calcium silicate fibre | 5.2 |

The second slurry was introduced into the mould over the layer obtained by dewatering the first slurry and the second slurry was dewatered through the previously deposited layer. The matter in the mould was then removed as a damp two layer slab and this slab was then heated to dry it and to harden the binders. The two layers adhered well and the first layer deposited i.e. the inward-facing layer in use had a density of 0.43 g/cm$^3$ and a thickness of 3 mm and the other layer i.e. the backing layer a density of 1.38 g/cm$^3$ and a thickness of 26 mm.

For comparative purposes, a further quantity of the second slurry was dewatered in the mould and the damp single layer slab removed and heated. The resultant slab had a thickness of 30 mm and a density of 1.38 g/cm$^3$.

A 250 mm square sample of the two layer slab was put, inward-facing layer downwards, on the hot plate, at 1400° C., of apparatus for determining thermal properties of materials. In view of its thermal capacity, the sample behaved as a heat sink and the power required to maintain the hot plate at 1400° C. over initial 5 and 10 minute intervals was determined. A 250 mm square sample of the single layer slab was tested likewise and the results were as follows:

| Sample | Thickness (mm) | Density (g/cm$^3$) | Power consumption (kw · sec) over 5 min. | Power consumption (kw · sec) over 10 min. |
|---|---|---|---|---|
| 2-layer | 26 + 3 | 1.38/0.43 | 14.4 | 27.0 |
| single layer | 30 | 1.38 | 22.2 | 40.8 |

The results show that the two layer slab of the invention has a markedly smaller initial chilling effect than the single layer slab.

EXAMPLE 2

A 5 mm thick aluminosilicate fibre board having the following analytical composition was put into a permeable mould:

| Constituent | % by weight |
|---|---|
| $Al_2O_3$ | 43.5 |
| $SiO_2$ | 45.5 |
| $Fe_2O_3$ | 0.9 |
| $Na_2O$ | 0.3 |
| CaO | 1.4 |

A slurry of the same composition as the second slurry in Example 1 was dewatered in the mould through the aluminosilicate board. The matter in the mould was then removed as a damp two layer slab and this slab was heated to dry it and to harden the binders derived from the slurry. The two layers adhered well and the aluminosilicate fibre board layer i.e. the inward-facing layer in use had a density of 0.26 g/cm$^3$ whilst the layer deposited from the slurry i.e. the backing layer had a density of 1.38 g/cm$^3$ and a thickness of 21 mm.

A 250 mm square sample of the two layer slab was tested as in Example 1 and the results, including again for comparative purposes those for the single layer sample of Example 1, were as follows:

| Sample | Thickness (mm) | Density (g/cm$^3$) | Power consumption (kw · sec) over 5 min. | 10 min. |
|---|---|---|---|---|
| 2-layer | 21 + 5 | 1.38/0.26 | 9.6 | 19.5 |
| single layer | 30 | 1.38 | 22.2 | 40.8 |

The results show that the two layer slab of the invention has a markedly smaller initial chilling effect than the single layer slab.

We claim:

1. A tundish, for use in the continuous casting of molten metal, having an outer metal casing, a permanent lining of refractory material adjacent the said casing and an inner, expendable lining comprising refractory, heat-insulating slabs, said slabs each comprising an erosion-resistant backing layer and an inward-facing layer of lower density than that of the backing layer, said backing layer located closer to said permanent lining than said inward-facing layer, and said backing and inward-facing layers being generally co-extensive along the width of the slab.

2. A tundish according to claim 1, wherein the erosion resistant backing layer has a density of at least 1.0 g/cm$^3$ and the inward-facing layer has a density of at least 0.2 g/cm$^3$ but which is not more than 85% of the density of the backing layer.

3. A tundish according to claim 1 in which the density of the inward-facing layer is not more than 60% of the density of the backing layer.

4. A tundish according to claim 1 in which a part or all of any particulate refractory material present in the inward-facing layer is of lower density than the refactory material of the backing layer.

5. A tundish according to claim 1 in which the inward facing layer includes an exothermally reactive ingredient.

6. A tundish according to claim 1 in which the thickness of the inward-facing layer is in the range of 2 to 10 mm and the thickness of the backing layer in the range of 20 to 35 mm.

7. A tundish according to claim 1 in which the inward-facing layer extends only over part of the inner face of the slab.

8. A tundish according to claim 7 in which the upper part of the slab is provided by the composition of the backing for the full thickness of the slab.

9. A tundish according to claim 4 wherein the lower density material in the inward-facing layer is selected from the group consisting essentially of calcined rice husks, fly ash floaters, expanded fireclay grog, expanded perlite, exfoliated graphite or charcoal, or combinations thereof.

10. A tundish according to claim 1 wherein each of the slabs comprises a slurry formed slab produced by putting a first slurry for forming one of the layers in a mold, dewatering the first slurry, and putting a second slurry for forming the other of the layers in the mold on top of the dewatered first slurry, and then dewatering the second slurry through the previously dewatered first slurry.

11. A tundish as recited in claim 1 wherein each slab comprises a slab formed by depositing a board having the desired properties of one of the layers in a mold, depositing a slurry having the properties of the other desired layer over the board in the mold, and dewatering the slurry in the mold through the board.

12. A tundish according to claim 2 wherein each of the slabs comprises a slurry formed slab produced by putting a first slurry for forming one of the layers in a mold, dewatering the first slurry, and putting a second slurry for forming the other of the layers in the mold on top of the dewatered first slurry, and then dewatering the second slurry through the previously dewatered first slurry.

13. A tundish as recited in claim 2 wherein each slab comprises a slab formed by depositing a board having the desired properties of one of the layers in a mold, depositing a slurry having the properties of the other desired layer over the board in the mold, and dewatering the slurry in the mold through the board.

14. A method of continuous casting molten metal comprising the steps of:

(a) constructing a tundish having an outer metal casing, a permanent lining of refractory material adjacent the casing, and an inner, expendable lining comprising refractory, heat insulating slabs, each slab comprising an erosion-resistant backing layer and an inward-facing layer of lower density than that of the backing layer, said backing layer located closer to the permanent lining than the inward-facing layer, and the layers being generally co-extensive along the width of the slab;

(b) pouring a ladleful, or sequence of ladlefuls, of molten metal through the tundish and from the tundish into a continuous casting mold; and (c) after completion of the pour of a ladleful, or a sequence of ladlefuls, through the tundish, replacing the inner lining while maintaining the permanent lining intact.

15. A method as recited in claim 16 wherein step (a) is practiced by slurry forming the slabs, the slurry forming being effected by: pouring into a mold a first slurry having properties desirable for forming one of the layers of the slab; dewatering the first slurry; pouring a second slurry into the mold on top of the dewatered first slurry, the second slurry having properties for forming the other of the layers of the heat insulating slab to be produced; dewatering the second slurry through the first slurry to form a dewatered slab; and removing the dewatered slab from the mold and then heating it to dry it to harden binders therein.

16. A method as recited in claim 17 wherein the first slurry is a slurry for forming the inward-facing layer of the slab.

17. A method as recited in claim 16 wherein step (a) is practiced by slurry forming the heat insulating slabs, the slurry forming of the slabs being effected by the steps of: disposing a fiber board having properties sufficient for it to serve as the backing layer of the slab to be formed, in a permeable mold; pouring a slurry having properties sufficient for it to form the inward-facing layer of the slab once formed, into the mold on top of the board; dewatering the slurry in the mold through the board; and removing the two layer slab from the mold, and heating it to dry it and to harden the binders derived from the slurry.

* * * * *